US005174413A

United States Patent [19]

Cappi et al.

[11] Patent Number: 5,174,413

[45] Date of Patent: Dec. 29, 1992

[54] PLASTIC BAG DISPENSING APPARATUS FOR SUPERMARKETS INCORPORATING DEVICES FOR THE REGISTERING OF THE PURCHASED ITEMS

[75] Inventors: Angelo Cappi, Vignola; Renato Rimondi, Bazzano, both of Italy

[73] Assignee: A.W.A.X. Progettazione E Ricerca S.R.L., Modena, Italy

[21] Appl. No.: 782,129

[22] Filed: Oct. 25, 1991

[30] Foreign Application Priority Data

Nov. 2, 1990 [IT] Italy ..... 21956 A/90

[51] Int. Cl.[5] ..... A47F 9/04

[52] U.S. Cl. ..... 186/66; 53/390; 53/570

[58] Field of Search ..... 186/59, 60, 61, 66; 53/385.1, 390, 500, 567, 570; 177/145

[56] References Cited

U.S. PATENT DOCUMENTS

| | | | |
|---|---|---|---|
| 3,628,632 | 12/1971 | Lambert | 186/66 |
| 4,020,618 | 3/1977 | Benzon-Petersen et al. | 186/66 X |
| 4,062,170 | 12/1977 | Orem | 53/390 |
| 4,068,451 | 1/1978 | Bewerse et al. | 53/385.1 |
| 4,085,822 | 4/1978 | Osborn | 53/385.1 X |
| 4,676,343 | 6/1987 | Humble et al. | 186/61 |
| 4,792,018 | 12/1988 | Humble et al. | 186/61 |
| 4,909,356 | 3/1990 | Rimondi et al. | 186/66 X |
| 4,912,906 | 1/1990 | Toner | 53/390 X |
| 4,953,664 | 9/1990 | Vrooman et al. | 186/61 X |

FOREIGN PATENT DOCUMENTS

| | | | |
|---|---|---|---|
| 0327514 | 8/1989 | European Pat. Off. . | |
| 0363335 | 4/1990 | European Pat. Off. | 186/66 |
| 429416 | 5/1991 | European Pat. Off. . | |
| 2161631 | 1/1986 | United Kingdom . | |

*Primary Examiner*—Michael S. Huppert
*Assistant Examiner*—Scott L. Lowe

[57] ABSTRACT

Apparatus for dispensing and opening plastic bags from a continuous strip wound in a reel apt to detach from it a bag (4) at a time, open it and keep it open below a mouth (8) through which a customer may insert into the underposed bag (4) the items he purchased, the apparatus comprises also a scanner (5) connected through a computer (7) to a shutter (11, 11') located on the mouth (8) so that the computer (7) controls the opening of the shutters (11, 11') and the inhibition of the scanner (5) when it has registered an item, and controls the reactivation of the scanner (5) and the closing of the shutters (11, 11') when the registered item has entered the bag (4) through the mouth (8).

12 Claims, 3 Drawing Sheets

PLASTIC BAG DISPENSING APPARATUS FOR SUPERMARKETS INCORPORATING DEVICES FOR THE REGISTERING OF THE PURCHASED ITEMS

BACKGROUND OF THE INVENTION

The present invention relates to an apparatus intended to be placed in supermarkets and in other similar points of sale to dispense one at a time plastic bags unwound from a reel, open them and keep them open below a mouth through which the customer of the supermarket may insert the purchased items that must be taken away, after having registered their characteristics and cost by means of a scanner connected to such apparatus by a computer.

It is known that recently in the supermarkets and other similar points of sale devices have been introduced to dispense plastic bags to the customers and allow them to easily insert in such bags, kept open by the device, the purchased items normally paid to the check-out counter. Already known devices of this kind are described, for instance, in the U.S. Patent application No. 07/613234 filed by the same applicant.

Such known devices have not any instrument to verify the characteristics of the purchased items so their use is solely limited to the packaging of the purchased goods. Thus they may be used only downstream the check-out counters of the supermarkets and therefore they do not contribute to reduce the time that cashiers need to register the goods purchased by each customer.

SUMMARY OF THE INVENTION

The object of the present invention is to provide a bag dispensing apparatus suitable to be used upstream the check-out counters of the supermarkets to allow the customer to register by himself the purchased goods and come to the check-out counter only to pay the due amount.

Such object is achieved according to the present invention by means of a bag dispensing apparatus of the type described in the above-mentioned prior European patent application characterized in that it comprises a scanner connected through a computer to a shutter located on the mouth for inserting the items.

The dispensing apparatus according to the present invention offers the advantage to allow the customer, besides the packaging of the purchased items, a precise registration of such items and therefore to stay at the check-out counter exclusively for the time necessary to the payment of the bill. Obviously this considerably limits the forming of queues at the check-out counters.

A further advantage offered by the dispenser according to this invention consists in that it can be directly connected by means of cables to the check-out counter therefore with no need even of the use of a printer to issue the cash-slips.

BRIEF DESCRIPTION OF THE DRAWINGS

These and other advantages of the dispensing apparatus according to the present invention will be clear to those skilled in the art from the following detailed description of one embodiment thereof with reference to the annexed drawings in which.

DESCRIPTION OF THE PRESENTLY PREFERRED EMBODIMENTS

Figure 1:
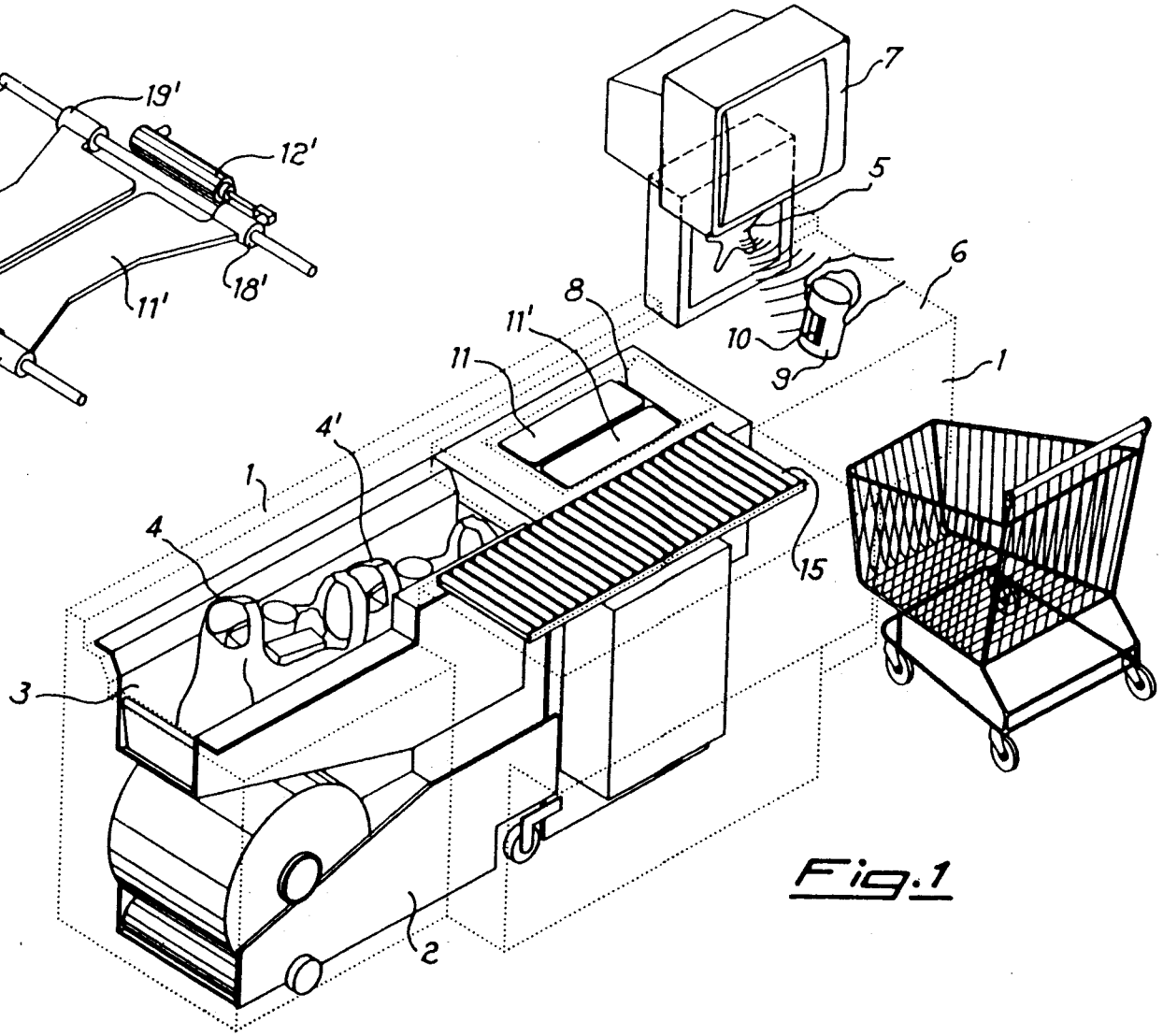
FIG. 1 shows a perspective view of a dispensing apparatus according to the present invention.

Referring to FIG. 1 there can be seen that the bag dispensing apparatus according to the present invention comprises a counter 1, similar to the check-out counters commonly used in many supermarkets, in which a bag dispensing device is incorporated of the type described in the above-mentioned U.S. patent application No. 07/613234 of which there can be seen the reel supporting device 2 and the channel for the ejection of the bags filled with items 4, 4' etc.

On counter 1, a scanner 5 is mounted to detect the bar code reproduced on the items on sale in the supermarket. Said detection is commonly defined "scannering". In front of the scanner 5 a work board 6 is provided, obtained on the upper part of counter 1.

The scanner 5 is connected to a computer 7 whose monitor is preferably superposed to scanner 5. In such a position the monitor can be easily read by the operator who can read on it all data supplied by the bar code, besides any possible instruction given by the computer, depending on the program in use.

The work board 6 is preferably arranged very close to the mouth 8 through which the items purchased by a customer may be inserted in the plastic bag dispensed by the dispensing device incorporated in counter 1.

As there may be seen in FIG. 1, the customer of the supermarket, after having carried, on a usual trolley, some items close to the work board 6, has kept the can 9 putting it close to the scanner 5 so that the latter can read the bar code 10 thereof. Data registered by the scanner appear on monitor 7 of the computer that elaborates such data and contemporarily controls the opening of shutters 11, 11' that block the feeding mouth 8. Simultaneously the computer inhibits scanner 5 thus avoiding the possibility that the customer may use the scanner to register a second item before can 9 has been inserted into the bag 4 arranged below the mouth 8.

The opening of shutters 11, 11' allows the customer to insert can 9 in the mouth 8, below which a photocell array 14 is arranged (visible in FIG. 3) that, when crossed by can 9, controls through the computer 7 the closing of shutters 11, 11'0 and the reactivation of scanner 5 thus allowing the customer to register another item he purchased. The customer may go on like this until he has no more purchased items or until the bag 4 is completely filled. In the first case he has nothing to do but pressing a suitable button which causes the ejection of the filled bag 4 pushing it in the channel 3 from which it may easily be taken by the customer before going to the check-out counter for the payment of the purchased goods.

In the second case where the bag 4 is completely filled, the customer reads on the monitor of the computer 7 the order to pull out from the mouth 8 the last item inserted therein because it has an encumbrance greater than the remaining space in the bag 4 and therefore it blocks the closing of shutters 11, 11'. Once the customer has pulled out from the mouth 8 the excess item, following the instructions read on the monitor, the photocell array 14 allows the closing of shutters 11, 11'. Simultaneously to the closing of shutters 11, 11' on the monitor the request appears for the customer to press the button for the ejection of the filled bag 4 and the dispensing of an empty bag 4' below the mouth 8. Simultaneously the scanner 5 is reactivated thus the customer may register a new item taken from the trolley and begin a new operating cycle until the complete packaging of all the items he purchased or until the complete filling of the new bag with consequent need of the dispensing of a further bag.

Using the apparatus according to the present invention the customer cannot make mistakes in the registration of the items he purchased therefore the cash-slip issued by the printer connected to the computer contains all the items purchased by the customer. In fact the closing of the mouth 8 by means of shutters 11, 11' avoids the mistake of inserting in the mouth 8 an item before having registered it by means of scanner 5. Likewise, the inhibition of scanner 5 after the opening of shutters 11, 11' prevents the customer from making the mistake of registering twice the same item before inserting it into the mouth 8.

For the bulky items which cannot pass through the mouth 8 and therefore cannot even be inserted into the plastic bags 4 a roller path 15 is provided on which they may be deposited after the registration by means of scanner 5. To avoid the possibility that such items are accidentally registered twice by the customer (or not registered at all) particular cautions may be provided, like for instance, to include in the bar code a suitable signal after the registration of which shutters 11, 11' do not open while scanner 5 is in anyway inhibited. The reactivation of scanner 5 would take place as soon as the bulky item is deposited on the roller path 15 in which a sensor is provided (not shown in the figure) reactivating the scanner 5.

Figure 2:
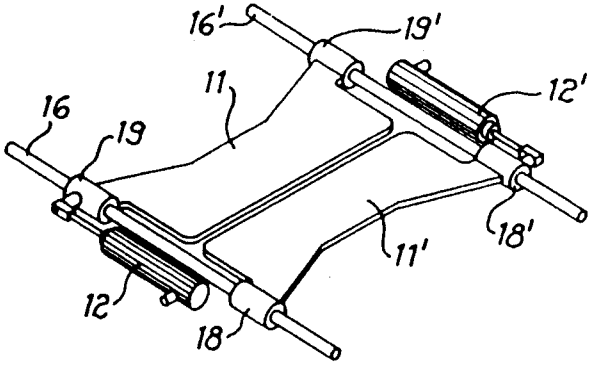
FIG. 2 shows a perspective view of the automatic shutter for the closing of the feeding mouth of the apparatus.

Referring to FIG. 2, that shows an enlarged view of shutters 11, 11' blocking the mouth 8, there can be seen that each shutter is connected to a pneumatic piston 12, 12' which, controlled by the computer, causes the mutual approaching or separation of shutters 11, 11' through their sliding along the horizontal guide 16, 16'. To attain such purpose each shutter is provided with a pair of sleeves 18, 18' and 19, 19' inserted in the guides 16, 16'. A sleeve of each pair is rigidly connected with the shaft of the pneumatic pistons 12, 12' which causes he sliding of said sleeve in the two directions along the guides 16, 16' causing the opening or the closing of shutters 11, 11'.

Figure 3:
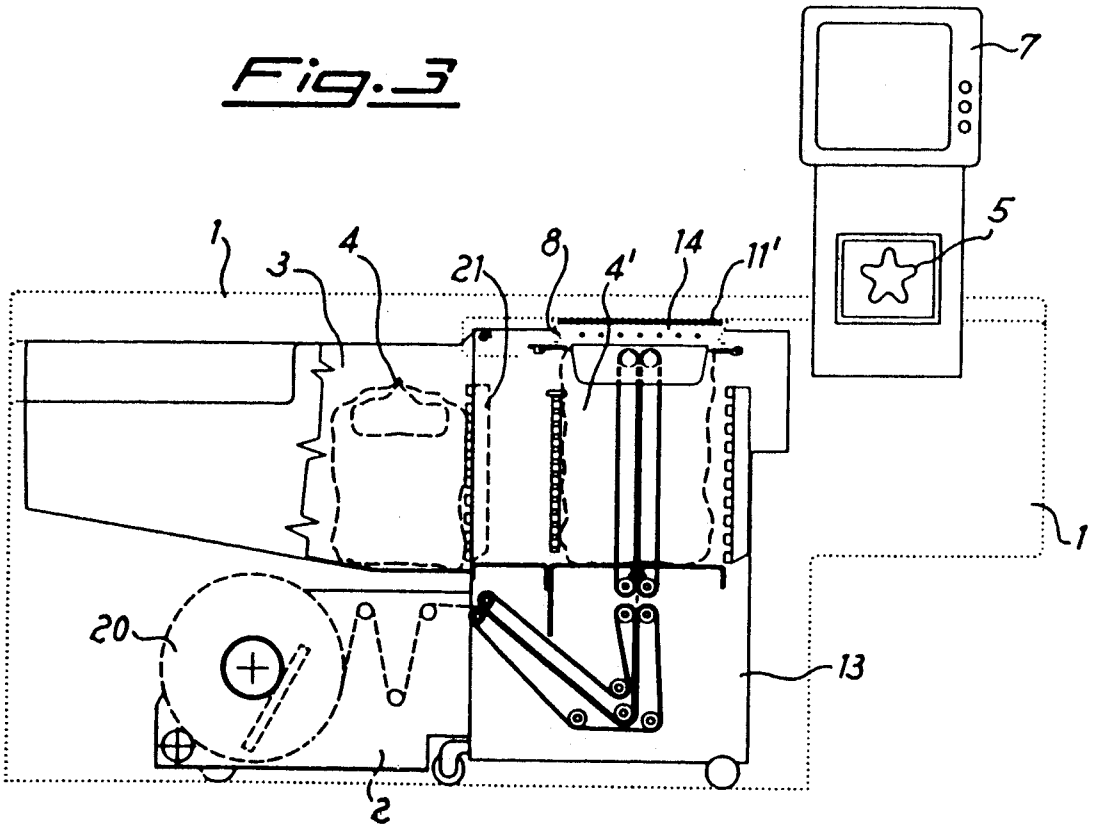
FIG. 3 shows an elevational partially sectioned front view of the apparatus according to the present invention.

In FIG. 3 there can be seen how inside counter 1 is mounted the plastic bag dispensing device of the type described in the U.S. patent application No. 07/613234 of the same applicant. In the drawing the reel supporter 2 can be identified sustaining the reel 20 formed by a multiplicity of plastic bags 4, 4', 4'' etc. joined in a sequence to form a continuous strip. Such strip is pulled by the device 13 towards the mouth 8 where the bags are opened one at a time and kept open for their filling with the items inserted through the mouth 8. In the figure the photocell array 14 is also shown detecting the passage of the items inserted in the mouth 8 thus giving the consent to the closing of shutters 11, 11' and to the reactivation of scanner 5.

In FIG. 3 the ejector 21 can be seen as well that pushes on the canal 3 a filled bag 4 that may be taken by the customer and brought to the check-out counter of the supermarket for the payment of the amount indicated on the cash-slip issued by the printer connected to the computer.

Figure 4:
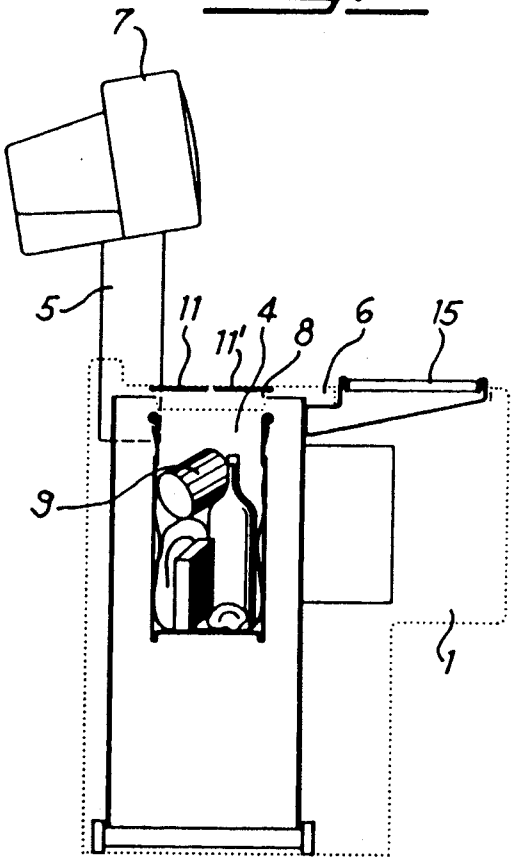
FIG. 4 shows an elevational partially sectioned side view of the dispensing apparatus.

In FIG. 4 there can be seen how a bag 4 appears during its filling inside the dispensing apparatus according to the present invention. Now the bag 4 can be seen almost filled while shutter 11, 11' are closed and therefore scanner 5 is ready for the registration of another item. If the encumbrance of the latter is greater than the remaining room still available inside bag 4, when it is inserted into the bag after its registration on the monitor the request will appear to pull out such item from bag 4, order the ejection of such bag and dispense a further empty bag 4' ready for the filling.

Figure 5:
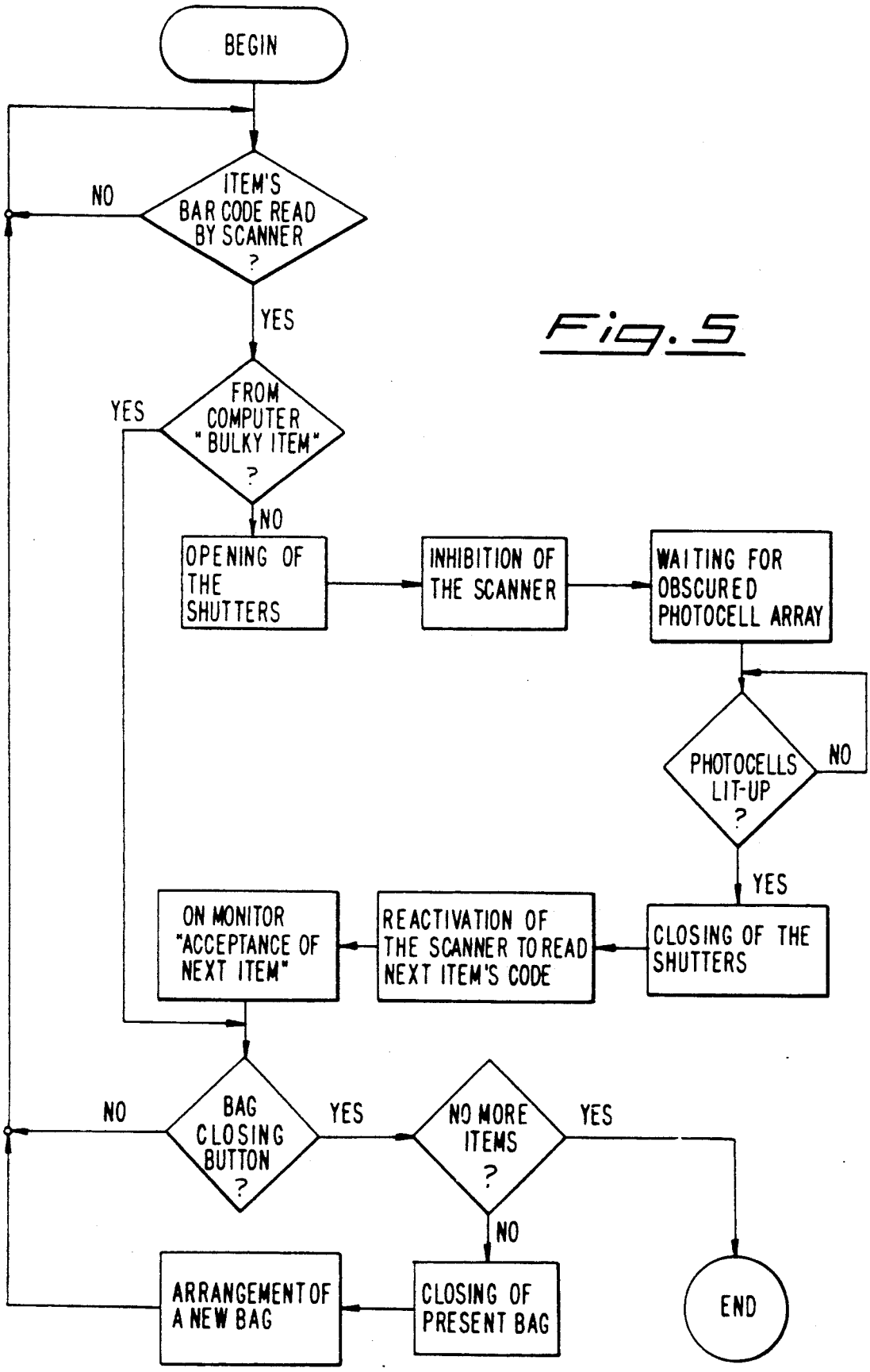
FIG. 5 shows a flow chart describing the functioning of such apparatus.

In FIG. 5 a flow chart is shown describing in a simple and clear manner the working of the apparatus according to the present invention.

In such flow-chart the operating step does not appear of the issuing of the cash-slip which the customer must show at the check-out counter for the payment of the items that he purchased and introduced in the plastic bag 4. The printer is not even shown in the other annexed drawings as it does not fall within the scope of the present invention. In fact it may be mounted, in a known way, in the apparatus according to the present invention, or it may be even eliminated. In this second case the check-out counter would directly receive by means of cables all data registered by the scanner and displayed on the monitor of computer 7 from which the customer would only have to note the amount to pay at the check-out counter.

Further variations and/or modifications may be made by those skilled in the art to the apparatus according to this invention and in particular to its embodiments hereinabove described to be intended only as non limiting examples of the apparatus itself.

We claim:

1. An apparatus for dispensing and opening plastic bags from a continuous strip wound in a reel apt to detach from it a bag (4) at a time, open it and keep it open below a mouth (8) through which a customer may insert in the underposed bag (4) the items he purchased, characterized in that it comprises also a scanner (5) connected through a computer (7) to a shutter (11, 11') located on the mouth (8) so that the computer (7) controls the opening of the shutters (11, 11') and the inhibition of the scanner (5) when it has registered an item, and controls the reactivation of the scanner (5) and the closing of the shutters (11, 11') when the registered item has entered the bag (4) through the mouth (8).

2. Apparatus according to claim 1, characterized in that the scanner (5) and the computer (7) are mounted on the counter (1) that incorporates devices for dispensing and opening the bags (4), and close to the mouth (8).

3. An apparatus according to claim 1, characterized in that immediately below the mouth (8) a photocell array (14) is arranged connected to the computer (7).

4. An apparatus according to claim 3, characterized in that the scanner (5) and the computer (7) are mounted on the counter (1) that incorporates devices for dispensing and opening the bags (4), and close to the mouth (8).

5. An apparatus according to claim 1, characterized in that it comprises also a roller path (15) apt to receive bulky items that cannot pass through the mouth (8), said roller path may have a sensor connected to the scanner (5) through the computer (7).

6. An apparatus according to claim 5, characterized in that the scanner (5) and the computer (7) are mounted on the counter (1) that incorporates devices for dispensing and opening the bags (4), and close to the mouth (8).

7. An apparatus according to claim 1, characterized in that the shutter (11, 11') is formed by two sliding elements actuated by two pneumatic cylinders (12, 12') both connected to the scanner (5) through the computer (7).

8. An apparatus according to claim 7, characterized in that the scanner (5) and the computer (7) are mounted on the counter (1) that incorporates devices for dispensing and opening the bags (4), and close to the mouth (8).

9. An apparatus according to claim 7, characterized in that immediately below the mouth (8) a photocell array (14) is arranged connected to the computer (7).

10. An apparatus according to claim 9, characterized in that the scanner (5) and the computer (7) are mounted on the counter (1) that incorporates devices for dispensing and opening the bags (4), and close to the mouth (8).

11. An apparatus according to claim 7, characterized in that it comprises also a roller path (15) apt to receive bulky items that cannot pass through the mouth (8), said roller path may have a sensor connected to the scanner (5) through the computer (7).

12. An apparatus according to claim 11, characterized in that the scanner (5) and the computer (7) are mounted on the counter (1) that incorporates devices for dispensing and opening the bags (4), and close to the mouth (8).

* * * * *